US010466633B2

(12) United States Patent
Hara et al.

(10) Patent No.: US 10,466,633 B2
(45) Date of Patent: Nov. 5, 2019

(54) IMAGE FORMING APPARATUS

(71) Applicant: CANON KABUSHIKI KAISHA, Tokyo (JP)

(72) Inventors: Jun Hara, Kawasaki (JP); Yusuke Shimizu, Yokohama (JP); Kenichi Iida, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/217,728

(22) Filed: Dec. 12, 2018

(65) Prior Publication Data

US 2019/0196377 A1 Jun. 27, 2019

(30) Foreign Application Priority Data

Dec. 27, 2017 (JP) ..... 2017-252537

(51) Int. Cl.

| | |
|---|---|
| ***G03G 15/20*** | (2006.01) |
| ***G03G 15/00*** | (2006.01) |
| ***G03G 15/16*** | (2006.01) |
| *G03G 15/02* | (2006.01) |

(52) U.S. Cl.

CPC ..... *G03G 15/5004* (2013.01); *G03G 15/162* (2013.01); *G03G 15/2039* (2013.01); *G03G 15/2064* (2013.01); *G03G 15/0283* (2013.01)

(58) Field of Classification Search

CPC ..... G03G 15/0194; G03G 15/162; G03G 15/1675; G03G 15/2039; G03G 15/5004

See application file for complete search history.

(56) References Cited

U.S. PATENT DOCUMENTS

| | | | | |
|---|---|---|---|---|
| 2004/0184828 | A1* | 9/2004 | Bannai | G03G 15/0194 399/49 |
| 2008/0063418 | A1* | 3/2008 | Kyung | G03G 15/161 399/66 |
| 2015/0338813 | A1* | 11/2015 | Deno | G03G 15/043 399/395 |

FOREIGN PATENT DOCUMENTS

| | | | |
|---|---|---|---|
| JP | 11-219042 | A | 8/1999 |
| JP | 2003-149959 | A | 5/2003 |
| JP | 2011-215538 | A | 10/2011 |

* cited by examiner

*Primary Examiner* — Walter L Lindsay, Jr.
*Assistant Examiner* — Jessica L Eley
(74) *Attorney, Agent, or Firm* — Canon USA, Inc., IP Division

(57) ABSTRACT

A control unit controls a transfer power source in such a manner that a current value detected by a detection unit is a predetermined value while a transfer medium is not held in a transfer portion, and the control unit sets a transfer voltage based on a voltage value applied from the transfer power source to a transfer member. Then, the transfer voltage is applied from the transfer power source to a transfer roller after the leading edge of the transfer medium in the conveyance direction for the transfer medium is held in the transfer portion and before the leading edge is held in a fixing portion. While the transfer voltage is applied, the control unit sets a voltage to be applied from the transfer power source to the transfer member based on the value of current detected by the detection unit.

20 Claims, 13 Drawing Sheets

IMAGE FORMING APPARATUS

BACKGROUND OF THE INVENTION

Field of the Invention

The present disclosure generally relates to image forming apparatuses, such as copying machines, printers, and facsimile apparatuses, and more specifically to those that use an electrophotographic method or electrostatic recording method.

Description of the Related Art

In an electrophotographic image forming apparatus, a transfer voltage is applied to a transfer member disposed to face an image bearing member, such as a drum-shaped photosensitive member or intermediate transfer member, to electrostatically transfer a toner image borne on the image bearing member onto a transfer medium, such as a sheet or overhead projector (OHP) sheet. Thereafter, the transfer medium onto which the toner image is transferred at a transfer portion formed by the image bearing member and the transfer member is conveyed to a fixing unit and then heated and pressed by the fixing unit so that the toner image is fixed to the transfer medium.

Japanese Patent Application Laid-Open No. 11-219042 discusses an arrangement in which a conductive member disposed upstream from a transfer portion with respect to the conveyance direction for a transfer medium is provided with a current detection unit and a transfer voltage is set based on a result of detection by the current detection unit.

According to the arrangement discussed in Japanese Patent Application Laid-Open No. 11-219042, however, it is difficult to control the transfer voltage as appropriate, since the current leakage is undetectable if a current leakage occurs from a conductive member that is provided with no detection unit.

SUMMARY OF THE INVENTION

The present disclosure is generally directed to an image forming apparatus capable of controlling a transfer voltage as appropriate regardless of the current leakage path from a transfer portion via a transfer medium.

According to an aspect of the present disclosure, an image forming apparatus includes an image bearing member configured to bear a toner image, a transfer member configured to form a transfer portion where the transfer member is brought into contact with the image bearing member, a transfer power source configured to apply a voltage to the transfer member, a detection unit configured to detect a current flowing in the transfer member when the voltage is applied from the transfer power source to the transfer member, a control unit configured to control the transfer power source to transfer the toner image from the image bearing member onto a transfer medium by applying a first voltage from the power source to the transfer member, wherein the control unit sets the first voltage based on a value of the voltage applied from the transfer power source to the transfer member during a value of the current detected by the detection unit is a predetermined value while the transfer medium is not held in the transfer portion, and a fixing unit disposed downstream from the transfer member in a conveyance direction of the transfer medium, the fixing unit including a heating member configured to heat the transfer medium and a pressing member configured to form a fixing portion where the pressing member is brought into contact with the heating member, wherein while the transfer medium is held in the transfer portion, a predetermined voltage is applied from the transfer power source to the transfer member to transfer a toner image from the image bearing member onto the transfer medium, wherein the control unit sets a second voltage to be applied from the transfer power source to the transfer member, based on a simple average value of a current value detected by the detection unit during a predetermined time period, after a leading edge of the transfer medium in the conveyance direction for the transfer medium is held in the transfer portion and while the first voltage is applied from the transfer power source to the transfer member.

Further features of the present disclosure will become apparent from the following description of exemplary embodiments with reference to the attached drawings.

DESCRIPTION OF THE EMBODIMENTS

Various exemplary embodiments of the present disclosure will be described below with reference to the attached drawings. It should be noted that the dimensions, materials, shapes, relative locations, etc. of components described below are to be changed as needed according to various conditions and the structure of an apparatus to which an exemplary embodiment of the present disclosure is applied.

Thus, unless otherwise specified, the description below is not intended to limit the scope of the disclosure.

[Structure of Image Forming Apparatus]

Figure 1:
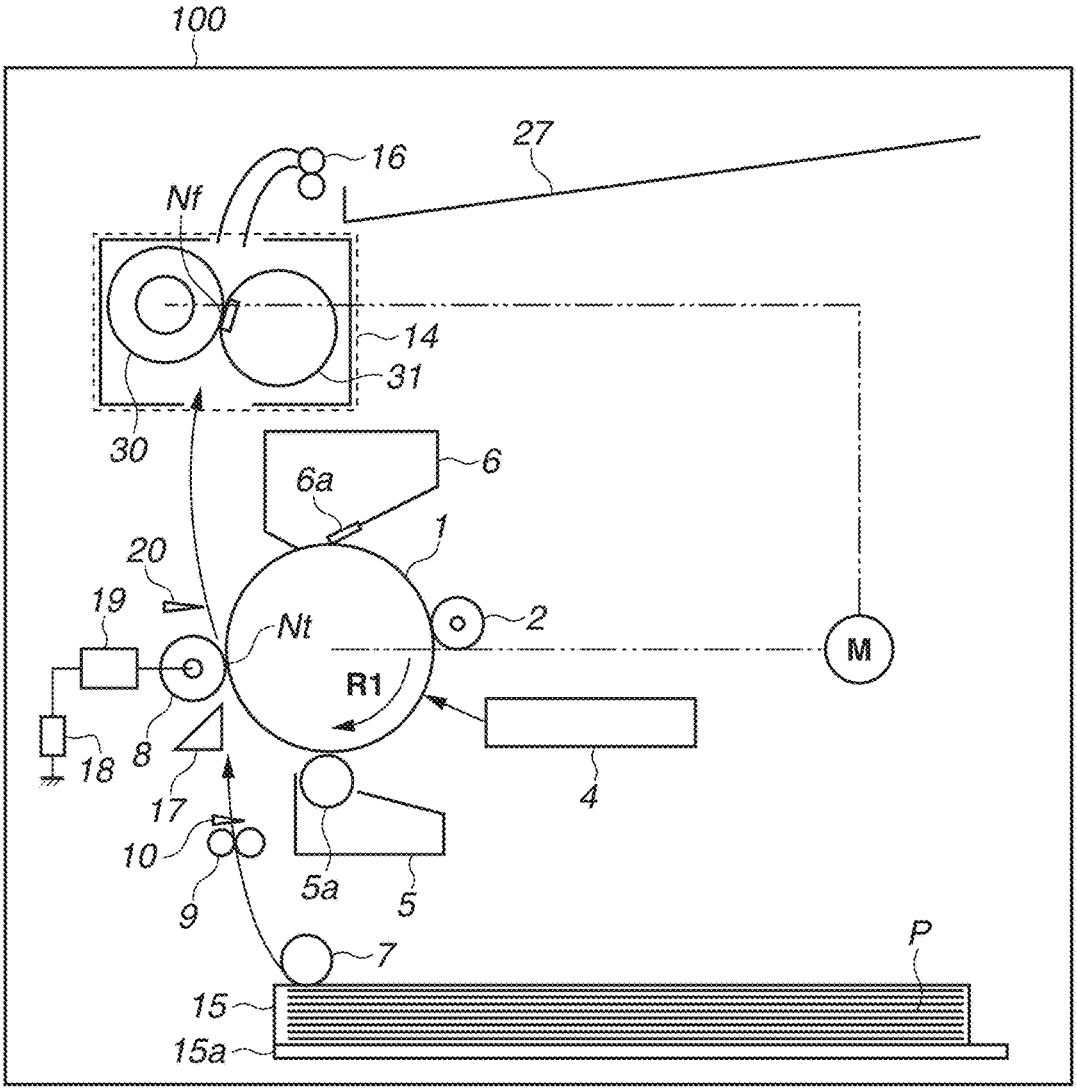
FIG. 1 is a cross sectional view schematically illustrating a structure of an image forming apparatus according to a first exemplary embodiment.
Figure 2:
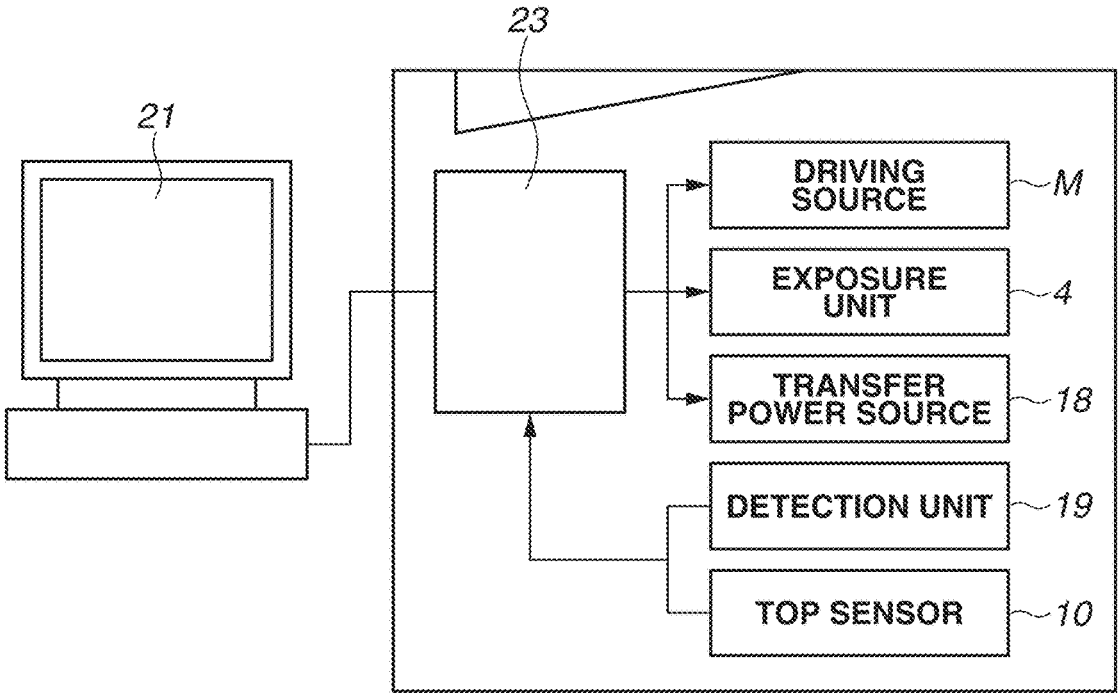
FIG. 2 is a block diagram illustrating a control system of the image forming apparatus according to the first exemplary embodiment.

FIG. 1 is a cross sectional view schematically illustrating an image forming apparatus 100 according to an exemplary embodiment of the present disclosure. FIG. 2 is a block diagram illustrating a control system of the image forming apparatus 100 according to the present exemplary embodiment. As illustrated in FIG. 2, the image forming apparatus 100 is connected to a personal computer 21 which is a host device. Operation start instructions and image signals from the personal computer 21 are transmitted to a controller circuit 23 which is a built-in control unit of the image forming apparatus 100. The controller circuit 23 controls various units to execute image forming in the image forming apparatus 100. The controller circuit 23 is capable of controlling various units based on detection results input from various control units and information input to the image forming apparatus 100 by a user.

As illustrated in FIG. 1, the image forming apparatus 100 according to the present exemplary embodiment includes a photosensitive drum 1 (image bearing member) which is a drum-shaped photosensitive member. The photosensitive drum 1 receives a driving force from a driving source M to be driven and rotated in the direction of an arrow R1 specified in FIG. 1 at a predetermined circumferential speed. The photosensitive drum 1 in the present exemplary embodiment has an outside diameter of 24 mm and is driven and rotated at a circumferential speed of 118 mm/seconds.

A charging roller 2, an exposure unit 4, a development unit 5, and a cleaning unit 6 are disposed around the photosensitive drum 1. The development unit 5 includes a development roller 5*a* which is a development member. The cleaning unit 6 includes a cleaning blade 6*a*. Toner is stored in the development unit 5, and a development power source (not illustrated) applies a voltage having polarity opposite to the normal charging polarity of the toner so that the development roller 5*a* can bear the toner stored in the development unit 5.

Further, a transfer roller 8 is disposed to face the photosensitive drum 1. The transfer roller 8 is a transfer member which is abutted against the photosensitive drum 1 to form a transfer portion Nt. The transfer roller 8 includes a metal core and an elastic member, such as rubber, which is conductive and formed on the surface of the metal core. In the present exemplary embodiment, the metal core has an outside diameter of 5 mm, the elastic member has a thickness of 3.75 mm, and the electric resistance value of the transfer roller 8 is adjusted to $10^7\Omega$ to $10^9\Omega$. Further, the transfer roller 8 is connected to a transfer power source 18. Between the transfer roller 8 and the transfer power source 18, a detection unit 19 which detects a current flowing toward the transfer roller 8 is provided.

A fixing unit 14 including a pressing member 30 and a heating member 31 is provided downstream from the transfer portion Nt in the conveyance direction for a transfer medium P. Further, the image forming apparatus 100 includes a sheet feeding cassette 15 and a sheet discharge tray 27. The sheet feeding cassette 15 is a storage unit which stores the transfer mediums P such as sheets and overhead projector (OHP) sheets. The sheet discharge tray 27 is a stacking unit for stacking the transfer mediums P on which an image is formed and which are discharged from the image forming apparatus 100.

A pre-transfer guide 17, a top sensor 10, a sheet conveyance roller 9 which is a conveyance unit, a sheet feeding roller 7 which is a sheet feeding unit, and the sheet feeding cassette 15 are disposed upstream from the transfer portion Nt in the conveyance direction for the transfer medium P. The pre-transfer guide 17 is a guide member for guiding the transfer medium P conveyed by the sheet conveyance roller 9 to the transfer portion Nt. In the present exemplary embodiment, a pre-transfer guide made of an insulative polycarbonate-acrylonitrile butadiene styrene polymer (PC-ABS) resin is used as the pre-transfer guide 17. The top sensor 10 is capable of detecting the leading edge of the transfer medium P fed from the sheet feeding cassette 15 by the sheet feeding roller 7 in the conveyance direction for the transfer medium P, and detection results detected by the top sensor 10 are input to the controller circuit 23, as illustrated in FIG. 2.

An image forming operation is started in response to the receipt of an image signal by the controller circuit 23 (illustrated in FIG. 2), and the photosensitive drum 1 is driven and rotated. During the rotation, the photosensitive drum 1 is uniformly charged to a predetermined potential by the charging roller 2 to which a voltage having predetermined polarity (which is negative in the present exemplary embodiment) is applied by a charging power source (not illustrated). Thereafter, the photosensitive drum 1 is exposed by the exposure unit 4 based on the image signal, and an electrostatic latent image corresponding to a target image is formed on the surface of the photosensitive drum 1. The electrostatic latent image is developed by the development roller 5*a* bearing the toner in a development position and visualized as a toner image on the photosensitive drum 1. According to the present exemplary embodiment, the normal charging polarity of the toner stored in the development unit 5 is negative, and the electrostatic latent image is developed by reversal development with the toner charged to the same polarity as the charging polarity of the photosensitive drum 1 by the charging roller 2. Applications of an exemplary embodiment of the present disclosure are not limited to the above-described application, and an exemplary embodiment of the present disclosure is also applicable to an image forming apparatus in which an electrostatic latent image is developed by positive development with toner charged to the opposite polarity to the charging polarity of the photosensitive drum 1.

A voltage having polarity (which is positive in the present exemplary embodiment) opposite to the normal charging polarity of the toner is applied from the transfer power source 18 to the transfer roller 8 and the toner image formed on the photosensitive drum 1 is transferred in the transfer portion Nt onto the transfer medium P fed from the sheet feeding cassette 15. After the leading edge of the transfer medium P conveyed to the transfer portion Nt is detected by the top sensor 10 provided upstream from the transfer portion Nt in the conveyance direction for the transfer medium P, the transfer medium P is held in the transfer portion Nt, and the toner image is transferred from the photosensitive drum 1 onto the transfer medium P. The transfer roller 8 is biased toward the photosensitive drum 1 by a biasing unit (not illustrated), and when the toner image is transferred from the photosensitive drum 1 onto the transfer medium P, the transfer roller 8 is rotated by the rotation of the photosensitive drum 1.

The electric resistance value of the transfer roller 8 changes based on the temperature and humidity of the surrounding environment, durability of the transfer roller 8, etc. Thus, when the toner image is transferred from the photosensitive drum 1 onto the transfer medium P, the voltage (hereinafter, "transfer voltage Vt") to be applied from the transfer power source 18 to the transfer roller 8 is set based on the change in the electric resistance value of the transfer roller 8. More specifically, the transfer voltage Vt is set by control referred to as "active transfer voltage control" (ATVC). The following describes ATVC.

First, constant current control is performed in such a manner that a current of a predetermined value flows in the transfer roller 8 before the transfer medium P reaches the transfer portion Nt, and the electric resistance value of the transfer roller 8 is calculated from the value of voltage V0 that is applied from the transfer power source 18 to the transfer roller 8 during the constant current control. The current flowing in the transfer roller 8 is detected by the detection unit 19, and the controller circuit 23 controls the transfer power source 18 based on the detection result input from the detection unit 19. In this way, the constant current control is performed.

Next, the controller circuit 23 refers to a look-up table (LUT) recorded in advance in a built-in memory to set the transfer voltage Vt (first voltage) based on the calculated electric resistance value of the transfer roller 8 and the value of the voltage V0. The controller circuit 23 thereafter feeds back the set transfer voltage Vt to the transfer power source 18, and the transfer power source 18 applies the transfer voltage Vt to the transfer roller 8 to transfer the toner image onto the transfer medium P in the transfer portion Nt. According to the present exemplary embodiment, when the toner image is transferred from the photosensitive drum 1 onto the transfer medium P, constant voltage control is performed based on the transfer voltage Vt set by the above-described method.

The transfer medium P onto which the toner image is transferred in the transfer portion Nt is conveyed to the fixing unit 14 after charges accumulated on the surface of the transfer medium P are neutralized by a neutralizing member 20. Then, the transfer medium P is heated by the heating member 31 and pressed by the pressing member 30 in the fixing unit 14 so that the toner image is fixed to the transfer medium P. The toner (residual toner) that remains on the surface of the photosensitive drum 1 after the toner image is transferred onto the transfer medium P is cleaned and removed by the cleaning blade 6*a* and collected into the cleaning unit 6. The transfer medium P to which the toner image is fixed in the fixing unit 14 is discharged to the sheet discharge tray 27 by a pair of sheet discharge rollers 16. The image forming apparatus 100 in the present exemplary embodiment performs the above-described operations to form an image on the transfer medium P.

[Fixing Unit]

Figure 3:
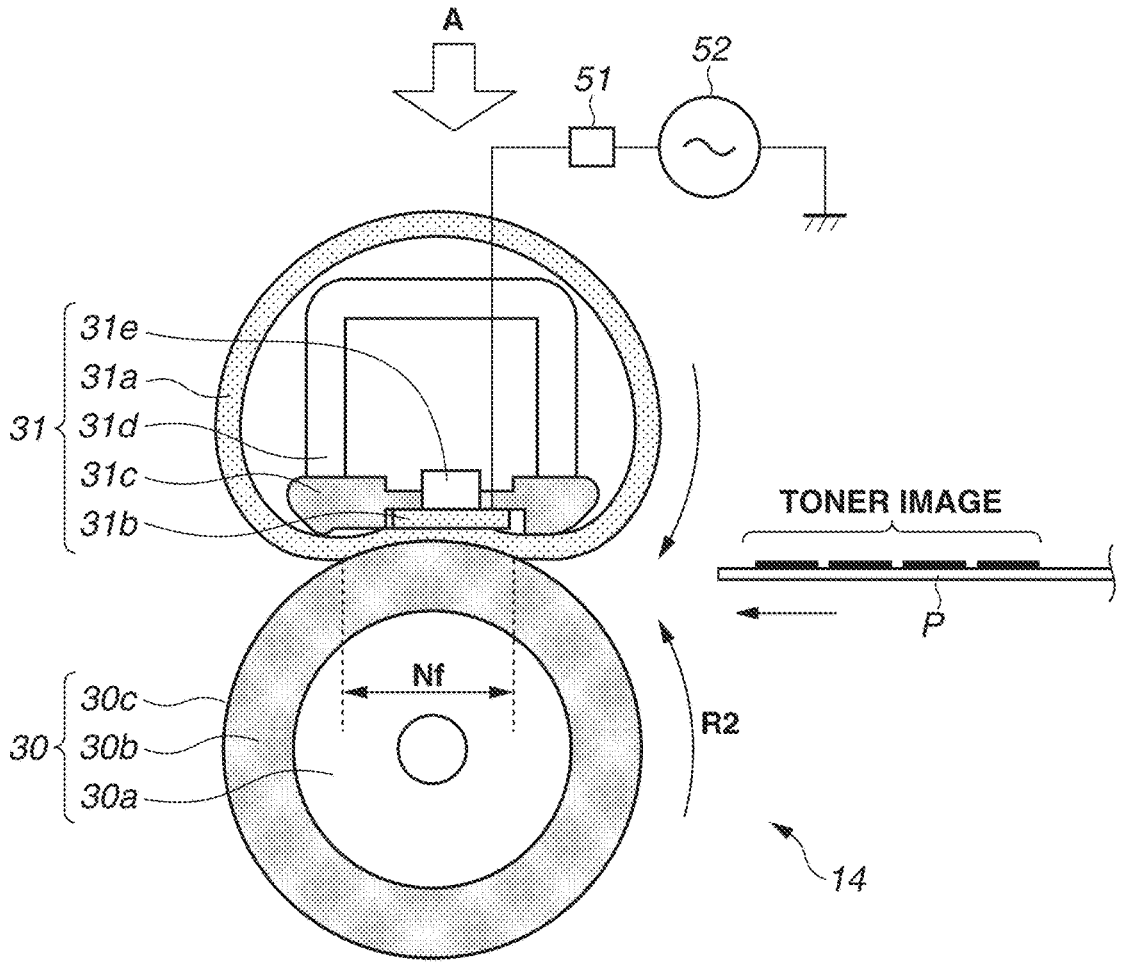
FIG. 3 is a cross sectional view schematically illustrating a structure of a fixing unit according to the first exemplary embodiment.

The present exemplary embodiment employs a fixing unit using a film fixing method. FIG. 3 is a cross sectional view schematically illustrating the structure of the fixing unit 14 according to the present exemplary embodiment. As illustrated in FIG. 3, the fixing unit 14 includes the pressing member 30 and the heating member 31, and the pressing member 30 presses the heating member 31 to form a fixing portion Nf which is a fixing portion capable of holding the transfer medium P onto which the toner image is transferred.

The pressing member 30 is a roller having an outside diameter of 14 mm and including a metal core 30*a*, an elastic layer 30*b*, and a release layer 30*c*. The elastic layer 30*b* is formed on the outer periphery of the metal core 30*a*. The release layer 30*c* is formed on the outer periphery of the elastic layer 30*b*. Silicone rubber, fluoro-rubber, etc. can be used as the elastic layer 30*b*, and a fluoro-resin, such as a tetrafluoroethylene-perfluoro alkyl vinyl ether copolymer (PFA), etc. can be used as the release layer 30*c*. The pressing member 30 is rotatably supported at respective ends of the metal core 30*a* in the lengthwise direction.

The heating member 31 includes a film 31*a*, a heater 31*b*, a support portion 31*c*, and a pressing stay 31*d*. The heater 31*b* is in the shape of a plate and disposed to face the pressing member 30 via the film 31*a* and be in contact with the inner periphery of the film 31*a*. The support portion 31*c* supports the heater 31*b*. The pressing stay 31*d* reinforces the support portion 31*c*. The heater 31*b* which is a heating unit is disposed in the fixing portion Nf, and an alternating-current voltage is applied to the heater 31*b* from a commercial power source (alternating-current power source) through a bidirectional thyristor 51 (triode for alternating current (TRIAC)). The controller circuit 23 controls the current flowing to a gate of the bidirectional thyristor 51 to turn on/off the bidirectional thyristor 51, and the alternating-current voltage to be applied to the heater 31*b* is controlled to adjust the temperature of the heater 31*b*.

The film 31*a* is a roll-shaped flexible member including a substrate layer (not illustrated), an elastic layer (not illustrated), and a release layer (not illustrated). The elastic layer is formed on the outer periphery of the substrate layer. The release layer is formed on the outer periphery of the elastic layer. The substrate layer of the film 31*a* needs to be resistant to heat to receive heat from the heater 31*b* and needs to have durability to rub against the heater 31*b*, so a metal, such as stainless steel or nickel, or a heat-resistant resin, such as polyimide, is desirably used as the substrate layer of the film 31*a*. Further, a fluoro-resin, such as perfluoroalcoxy resin (PFA) or polytetrafluoroethylene resin (PTFE), is desirably used as the release layer of the film 31*a*. The film 31*a* in the present exemplary embodiment has an outside diameter of 18 mm. Polyimide with a thickness of about 60 μm is used as the substrate layer of the film 31*a*. Silicon rubber with a thickness of about 150 μm is used as the elastic layer of the film 31*a*. Further, PFA which is excellent in releasability and heat-resistance among fluoro-resins is used as the release layer, and the thickness of the release layer is set to 10 μm.

Figure 4A:
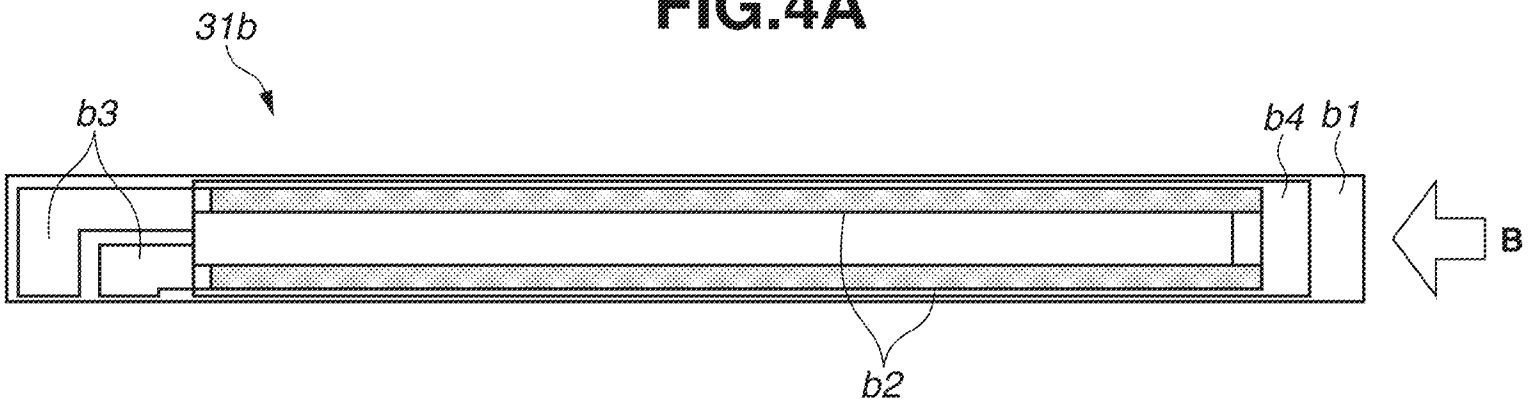
FIGS. 4A and 4B are schematic views each illustrating a heating unit according to the first exemplary embodiment.
Figure 4B:
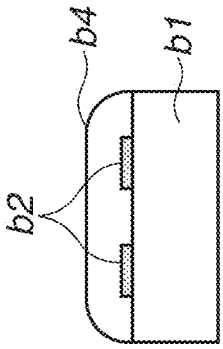

FIG. 4A is a schematic view illustrating the structure of the heater 31*b* viewed from the direction of an arrow A specified in FIG. 3. FIG. 4B is a schematic view illustrating the structure of the heater 31*b* viewed from the direction of an arrow B specified in FIG. 4A. As illustrated in FIG. 4A, the heater 31*b* includes a substrate b1 of alumina and a heat generation resistor b2 of a silver-palladium alloy. The substrate b1 has a thickness of 1 mm in the thickness direction and a width of 6 mm in the direction in which the transfer medium P is conveyed. The heat generation resistor b2 is formed on the substrate b1 by screen printing to have a thickness of about 10 μm. One of the ends of the heat generation resistor b2 is provided with an electrode portion b3, and the electrode portion b3 is electrically connected to the commercial power source 52. An alternating-current voltage applied from the commercial power source 52 to the electrode portion b3 causes a current to flow in the heat generation resistor b2 via the electrode portion b3, and the heat generation resistor b2 generates heat. Further, as illustrated in FIG. 4B, the heater 31*b* includes a protection layer b4 which protects the heat generation resistor b2. The protection layer b4 has a thickness of 60 μm and is formed by a glass coating.

As illustrated in FIG. 3, a thermistor 31*e* which detects the temperature of the heater 31*b* is attached to a surface of the heater 31*b* that is opposite to a surface that is in contact with the film 31*a*. The controller circuit 23 performs control to turn on/off the bidirectional thyristor 51 based on a result of detection by the thermistor 31*e*, and the amount of current flowing in the heat generation resistor b2 is adjusted by the control to adjust the temperature of the heater 31*b*.

The support portion 31*c* is made of a liquid crystal polymer and has rigidity, heat resistance, and heat insulation properties. The support portion 31*c* has the role of supporting the inner periphery of the film 31*a* being in contact with the support portion 31*c* and the role of supporting the heater 31*b*. The pressing stay 31*d* has a U-shaped cross section when viewed from the lengthwise direction in order to increase the flexural rigidity of the heating member 31. The pressing stay 31*d* is formed by bending a stainless-steel plate having a thickness of 1.6 mm.

When the fixing unit 14 fixes a toner image to the transfer medium P, a rotation force from the driving source M is transmitted to the pressing member 30, and the pressing member 30 is driven and rotated in the direction of an arrow R2 specified in FIG. 3 at a predetermined speed, as illustrated in FIG. 3. In this way, the film 31*a* is driven by the rotation of the pressing member 30 while rubbing against the heater 31*b*.

The transfer medium P is guided into the fixing portion Nf while the film 31*a* and the pressing member 30 are rotated, a current is applied to the heater 31*b*, and the temperature detected by the thermistor 31*e* for the heater 31*b* reaches a target temperature. The toner image transferred onto the transfer medium P in the transfer portion Nt is heated and pressed while the transfer medium P is conveyed through the fixing portion Nf, whereby the toner image is melted and fixed to the transfer medium P. The transfer medium P conveyed through the fixing portion Nf is separated from the film 31*a* due to the curvature of the film 31*a* and discharged to the sheet discharge tray 27 by the pair of sheet discharge rollers 16.

The distance from the transfer portion Nt to the fixing portion Nf in the image forming apparatus 100 according to the present exemplary embodiment is 40 mm. More specifically, in the cases of forming an image on a normal A4-size or letter-size transfer medium P, a toner image is fixed to the transfer medium P in the fixing unit 14 concurrently with transfer of the toner image from the photosensitive drum 1 onto the transfer medium P in the transfer portion Nt.

[Transfer Control]

Figure 5:
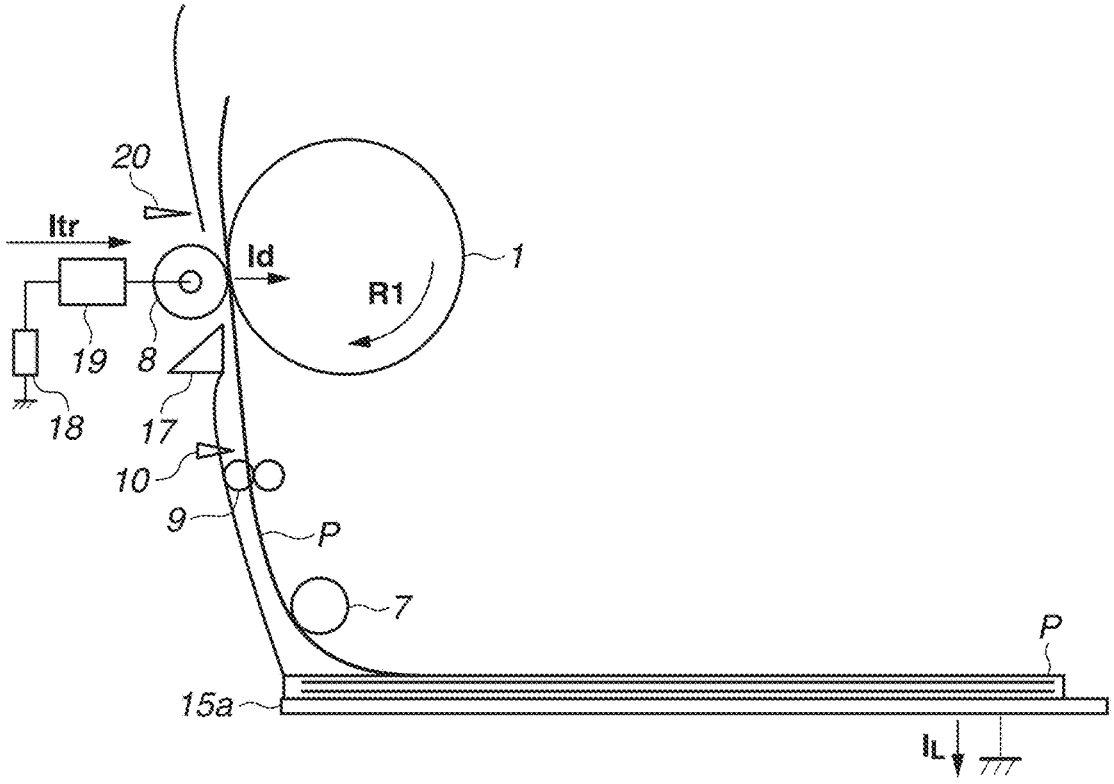
FIG. 5 is a schematic view illustrating a current flowing in a transfer portion according to the first exemplary embodiment.

FIG. 5 is a schematic view illustrating a current leakage from the transfer portion Nt via the transfer medium P. As illustrated in FIGS. 1 and 5, the sheet feeding cassette 15 included in the image forming apparatus 100 according to the present exemplary embodiment includes a metal plate 15*a* which is an electrically-grounded conductive member, and the metal plate 15*a* is grounded without an electric resistor. The metal plate 15*a* is a conductive member which is conductive with respect to the transfer medium P held in the transfer portion Nt, and the current flowing in the transfer portion Nt can leak to the ground via the transfer medium P and a metal plate 24 depending on the electric resistance of the transfer mediums P stacked in the sheet feeding cassette 15. A current $I_{tr}$ detected by the detection unit 19 when the transfer power source 18 applies a voltage to the transfer roller 8 is divided into a current Id and a current $I_L$. The current Id flows from the transfer roller 8 toward the photosensitive drum 1 via the transfer medium P. The current $I_L$ flows into the ground via the transfer medium P and the metal plate 24.

In the present exemplary embodiment, the transfer voltage Vt is controlled based on the current $I_L$. The following describes details of the control according to the present exemplary embodiment in a case of forming an entirely black solid image on a transfer medium P, Red Label A4-size sheet (grammage 80 g/m$^2$) manufactured by Océ, under a high-temperature, high-humidity environment with a room temperature of 32.5 degrees and a humidity of 80%. Two types of the transfer medium P were prepared, a moisture-absorbed sheet having been left under a high-temperature, high-humidity environment for 48 hours and thus having absorbed moisture and an immediately-unwrapped sheet immediately unwrapped, and the image forming was performed on the respective sheets. Further, the value of the voltage V0 in the case in which ATVC was performed to cause a current of 3 μA to flow was 500 V. From this result, the controller circuit 23 set the transfer voltage Vt to be applied from the transfer power source 18 to the transfer roller 8 in the case of transferring a toner image from the photosensitive drum 1 onto the transfer medium P to 750 V and started image forming.

A current signal that is actually detected by the detection unit 19 contains noise, etc. on the circuit. Thus, according to the present exemplary embodiment, the simple moving average of a current signal detected by the detection unit 19 is calculated twice to obtain a waveform, and the simple average of the obtained waveform is calculated, and the calculated value of the simple average is determined as the current $I_{tr}$. More specifically, the current $I_{tr}$ is obtained in a predetermined time period corresponding to a section of about 10 mm in the conveyance direction for the transfer medium P from the application timing for the transfer voltage Vt from the transfer power source 18 to the transfer roller 8 excluding the waiting period for a circuit response. Then, a change width ΔV in the transfer voltage Vt is determined using the current $I_{tr}$ and formula 1 below.

While the waiting period for a circuit response depends on the circuit configuration, it is suitable to delay the calculation of the current $I_{tr}$ during the predetermined period until the output from the transfer power source 18 and the signal detected by the detection unit 19 are stabilized to control the transfer voltage Vt with greater accuracy. According to the present exemplary embodiment, the waiting period was set to 100 millisecond (ms) from the timing when the transfer voltage Vt has been applied from the transfer power source 18 to the transfer roller 8, and the current $I_{tr}$ was calculated after the period of 100 ms had passed.

$$\Delta V = \frac{I_L}{I_M} \times V_M \tag{1}$$

In formula (1), the current $I_M$ is a current at the time when the electric resistance value of the transfer medium P is low and the current flowing from the transfer portion Nt to the ground via the transfer medium P and the metal plate 15*a* becomes the maximum value. Further, the voltage $V_M$ is a voltage that needs to be applied from the transfer power source 18 to the transfer roller 8 in order to transfer a toner image from the photosensitive drum 1 onto the transfer medium P in the case in which the current $I_M$ flows from the transfer portion Nt to the ground, and is a voltage different from the transfer voltage Vt determined by ATVC. Further, formula 1 is convertible into formula (2) below.

$$\Delta V = \frac{I_L}{I_M} \times V_M = \frac{I_{tr} - I_{tr1}}{I_{tr2} - I_{tr1}} \times V_M \tag{2}$$

The current $I_{tr1}$ is a transfer current that is used for transferring a toner image from the photosensitive drum 1 to the transfer medium P in the transfer portion Nt in the case in which the electric resistance of the transfer medium P is high and no current flows from the transfer portion Nt to the ground via the transfer medium P and the metal plate 15*a*. Specifically, the current $I_L$ is calculated by subtracting the current $I_{tr1}$ from the current $I_{tr}$ detected by the detection unit 19. Further, the current $I_{tr2}$ is a transfer current that is used for transferring a toner image from the photosensitive drum 1 to the transfer medium P in the transfer portion Nt in the case in which the electric resistance value of the transfer medium P is low and the amount of the current flowing from the transfer portion Nt to the ground via the transfer medium P and the metal plate 15*a* reaches the maximum amount. Specifically, the current $I_M$ is calculated by subtracting the current $I_{tr1}$ from the current $I_{tr2}$.

In the present exemplary embodiment, the current $I_{tr1}$, the current $I_{tr2}$, the current $I_M$, and the voltage $V_M$ are each stored in advance in the controller circuit 23. The lower the electric resistance of the transfer roller 8 is, the greater the amount of the current $I_{tr}$ flowing to the transfer roller 8 becomes and the greater the amount of escape current to the metal plate 15*a* becomes. Thus, the current $I_{tr1}$ and the current $I_{tr2}$ are set based on the voltage V0 obtained by ATVC.

Figure 6:
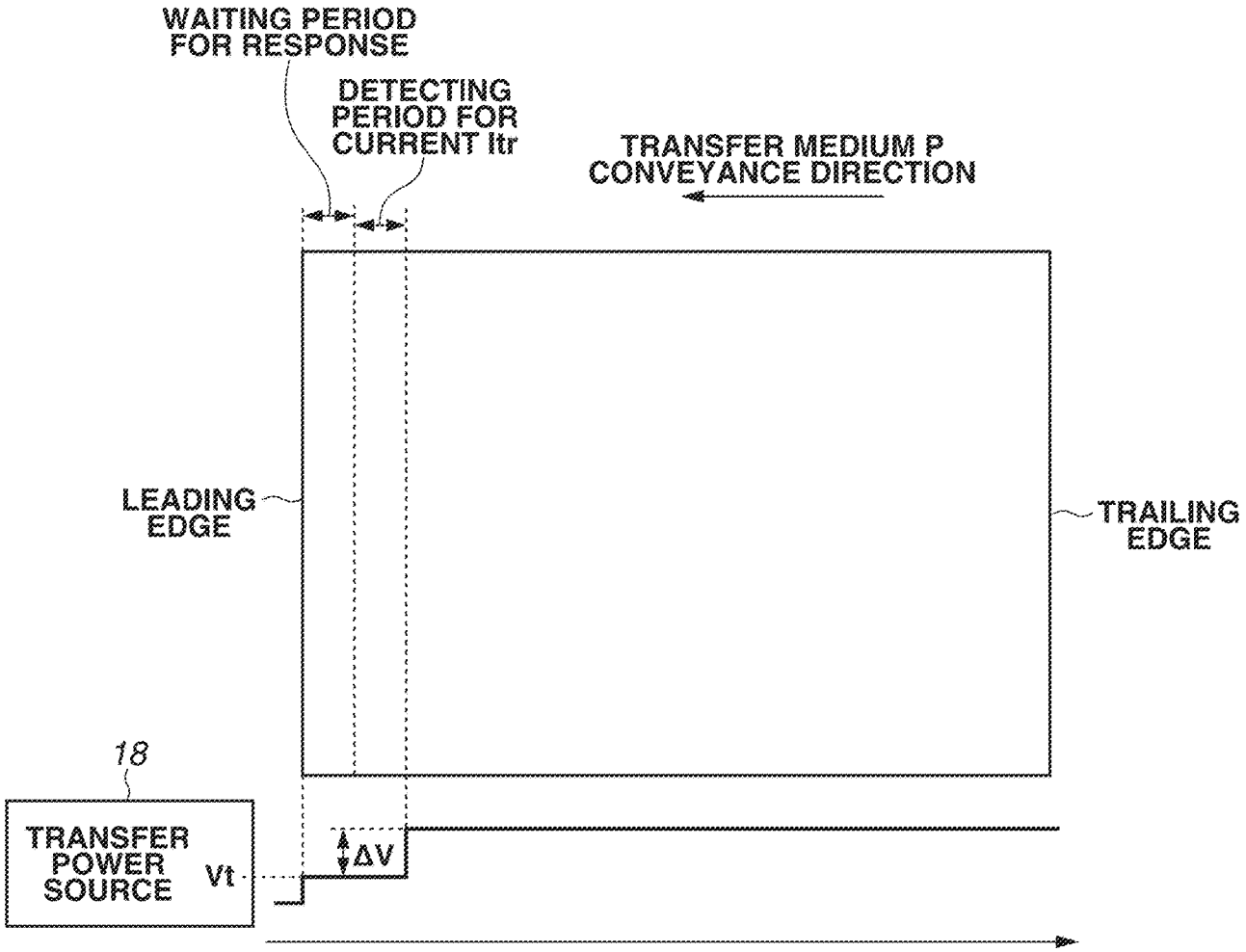
FIG. 6 is a schematic view illustrating transfer control according to the first exemplary embodiment.

FIG. 6 is a schematic view illustrating the transfer control in the present exemplary embodiment. As illustrated in FIG. 6, if the leading edge of the transfer medium P in the conveyance direction for the transfer medium P is held in the transfer portion Nt, the transfer voltage Vt obtained by ATVC is applied from the transfer power source 18 to the transfer roller 8. After the predetermined waiting period for a response passes in this state, the current $I_{tr}$ is detected, and the voltage to be applied from the transfer power source 18 to the transfer roller 8 is set to the sum (second voltage) of the transfer voltage Vt and the change width ΔV, from the transfer voltage Vt (750 V), according to formula (1) described above, etc.

For example, according to the case of performing image forming on the moisture-absorbed sheet in the present exemplary embodiment, the voltage V0 was 500 V, the current $I_{tr1}$ was 10.5 μA, the current $I_M$ was 1.5 μA, the voltage $V_M$ was 800 V, and the current $I_{tr}$ detected by the detection unit 19 was 11.1 μA. From the foregoing values and formula (1), the current $I_L$ is 0.6 μA and the change width ΔV=320 V. Thus, in the case of performing image forming on the moisture-absorbed sheet, after the detection unit 19 detects the current $I_{tr}$, the voltage to be applied from the transfer power source 18 to the transfer roller 8 is changed from 750 V to 1070 V.

The longer the transfer medium P is left under a high-temperature, high-humidity environment, the lower the electric resistance of the transfer medium P becomes and the more the amount of current leaking in the transfer portion Nt becomes. Further, the contact state between the metal plate 15*a* and the transfer medium P is not constant, and the contact resistance between the transfer medium P and the metal plate 15*a* changes depending on the thickness, orientation, etc. of the transfer mediums P stored in the sheet feeding cassette 15. For example, in the case which the sheet feeding cassette 15 stores a large amount of transfer mediums P, the level of contact between the transfer medium P and the metal plate 15*a* is high, and a more amount of current leaks to the ground. Further, if the level of contact between the transfer medium P and the metal plate 15*a* is changed due to the orientation of the transfer medium P, the amount of current leaking to the ground also changes.

First Comparative Example

Figure 7:
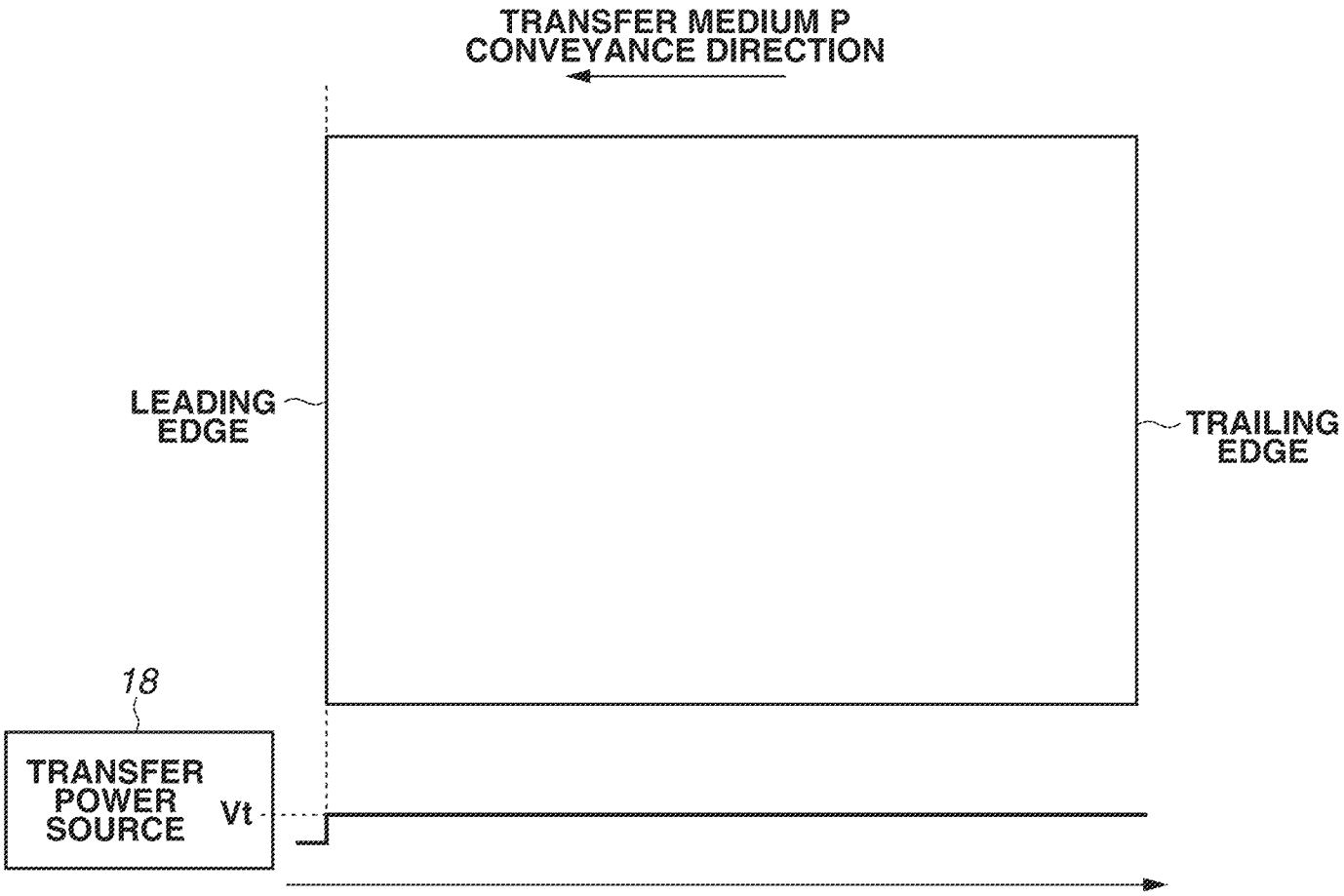
FIG. 7 is a schematic view illustrating transfer control according to a first comparative example.

FIG. 7 a schematic view illustrating the control in a first comparative example according to the present exemplary embodiment. The first comparative example is different from the present exemplary embodiment in that the voltage to be applied from the transfer power source 18 to the transfer roller 8 is not changed based on the detection result of the current $I_{tr}$ and the constant voltage control is performed using the transfer voltage Vt (750 V) regardless of whether the transfer medium P is a moisture-absorbed sheet or immediately-unwrapped sheet, as illustrated in FIG. 7. Hereinafter, components in the first comparative example that are similar to those in the present exemplary embodiment are respectively given the same reference numerals, and description of the similar components is omitted.

Second Comparative Example

Figure 8:
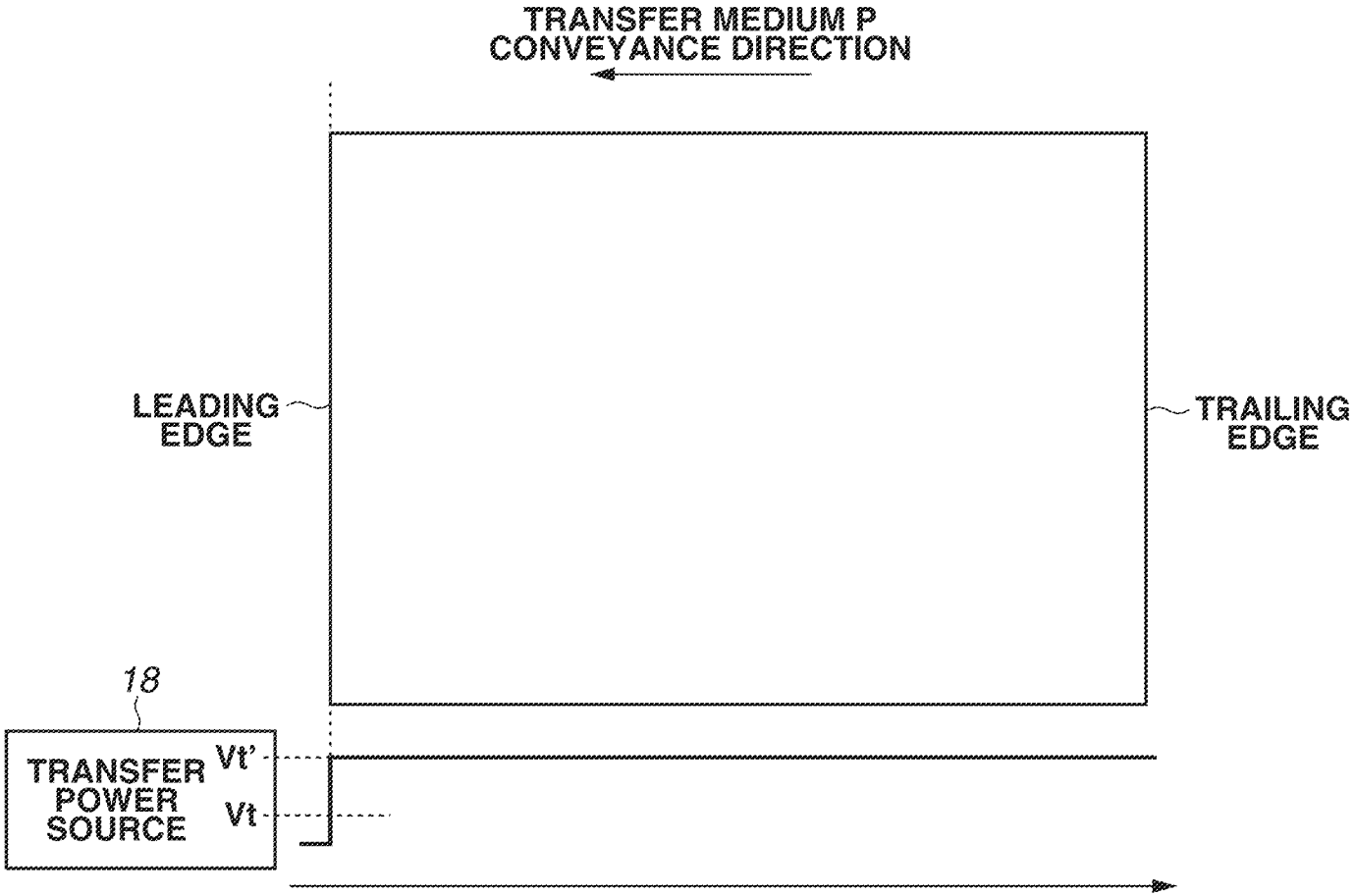
FIG. 8 is a schematic view illustrating transfer control according to a second comparative example.

FIG. 8 is a schematic view illustrating the control in a second comparative example in the present exemplary embodiment. The second comparative example is different from the present exemplary embodiment in that a leakage of the current flowing in the transfer portion Nt is supposed to occur at the timing at which the leading edge of the transfer medium P in the conveyance direction for the transfer medium P reaches the transfer portion Nt and thus the constant voltage control is performed using a voltage $V_t'$ which is higher than the transfer voltage Vt, as illustrated in FIG. 8. The voltage V' is a predetermined voltage stored in advance in the controller circuit 23, and in the second comparative example, the voltage V' is set to 1070 V regardless of whether the transfer medium P is a moisture-absorbed sheet or immediately-unwrapped sheet. Hereinafter, components in the second comparative example that are similar to those in the present exemplary embodiment are respectively given the same reference numerals, and description of the similar components is omitted.

<Image Evaluation Result>

An entirely black solid image was formed on a moisture-absorbed sheet and an immediately-unwrapped sheet in the present exemplary embodiment and the first and second comparative examples, and the following results were obtained.

First, in the first comparative example, when the image forming was performed on the moisture-absorbed sheet, a current leakage occurred from the transfer portion Nt to the ground via the transfer medium P and the metal plate 15*a* and thus the current flowing from the transfer roller 8 toward the photosensitive drum 1 in the transfer portion Nt became insufficient. This causes a transfer defect. Meanwhile, when the image forming was formed on the immediately-unwrapped sheet, no transfer defect occurred.

Further, in the second comparative example, no transfer defect occurred when the image forming was performed on the moisture-absorbed sheet. However, when the image forming was performed on the immediately-unwrapped sheet, an excessive current flowed from the transfer roller 8 to the photosensitive drum 1. This causes a transfer defect. This is because the voltage to be applied from the transfer power source 18 to the transfer roller 8 is set also with respect to the immediately-unwrapped sheets which have a high electric resistance and via which less current thus leaks from the transfer portion Nt to the ground, based on the assumption that a current leakage to the ground via the transfer medium P and the metal plate 15*a* is likely to occur.

On the contrary, according to the present exemplary embodiment, the voltage to be applied from the transfer power source 18 to the transfer roller 8 was controlled as appropriate regardless of the type of the transfer medium P and thus a transfer defect resulting from a current leakage from the transfer portion Nt to the ground via the transfer medium P and the metal plate 15*a* was prevented.

As described above, in the present exemplary embodiment, the voltage change width ΔV in the transfer portion Nt and the voltage to be applied to the transfer roller 8 are set based on the current detected by the detection unit 19 while the transfer voltage Vt set by ATVC is applied to the transfer roller 8. In this way, the voltage to be applied to the transfer roller 8 at the time of transferring a toner image onto the transfer medium P is controlled as appropriate.

While the arrangement in which the voltage change width ΔV in the transfer portion Nt and the voltage to be applied to the transfer roller 8 are set with respect to a single transfer medium P is described in the present exemplary embodiment, the arrangement is not limited to the above-described arrangement. For example, in the case of continuously performing image forming on a plurality of transfer mediums P (hereinafter, this image forming will be referred to as "continuous printing"), the transfer mediums P which are continuously conveyed are considered to have substantially the same electric resistance. Thus, the value of the change width ΔV that is set with respect to the first transfer medium P can be reflected in the voltage to be applied from the transfer power source 18 to the transfer roller 8 in the case of forming an image on the second transfer medium P.

More specifically, in the case of executing a continuous printing job, the voltage (transfer voltage Vt+change width ΔV) that is set at the time of forming an image on the first transfer medium P is applied from the transfer power source 18 to the transfer roller 8 and constant voltage control is performed from the leading edge to the trailing edge of the second transfer medium P. In this way, the waiting period for a response and the detection of the current $I_{tr}$ in FIG. 6 are omitted, and the transfer of a toner image onto the second transfer medium P is performed with an appropriate voltage from the leading edge of the second transfer medium P in the conveyance direction for the transfer medium P.

Further, while the metal plate 15*a* provided to the sheet feeding cassette 15 is described as the conductive member connected to the ground according to the present exemplary embodiment, the conductive member is not limited to the metal plate 15*a*. For example, an image forming apparatus including a guide member which is a conductive member disposed upstream from the transfer portion Nt in the conveyance direction for the transfer medium P and connected to the ground and is configured to guide the transfer medium P to the transfer portion Nt can perform control similar to the control in the present exemplary embodiment and produce a similar advantage.

Further, while the metal plate 15*a* is grounded without an electric resistor according to the present exemplary embodiment, the structure is not limited to the above-described structure, and the metal plate 15*a* can be grounded via an electric resistor having a predetermined resistance value. In this case, an advantage similar to that of the present exemplary embodiment is produced by storing the electric resistance value of the electric resistor in advance in the controller circuit 23 and calculating the change width ΔV based on the electric resistance value.

Second Exemplary Embodiment

According to the first exemplary embodiment, the arrangement in which the voltage change width ΔV is set based on the current $I_{tr}$ detected by the detection unit 19 while the transfer medium P is held in the transfer portion Nt and the transfer voltage Vt is applied from the transfer power source 18 to the transfer roller 8, and the change width ΔV is fed back to the transfer control is described. According to a second exemplary embodiment, the voltage change width ΔV is set using a method similar to the method in the first exemplary embodiment, but the second exemplary embodiment is different from the first exemplary embodiment in that the change width ΔV is fed back to the transfer control at or after the point at which the transfer medium P reaches the fixing portion Nf. In the following description, components that are similar to those in the first exemplary embodiment are given the same reference numerals, and description of the similar components is omitted.

Figure 9:
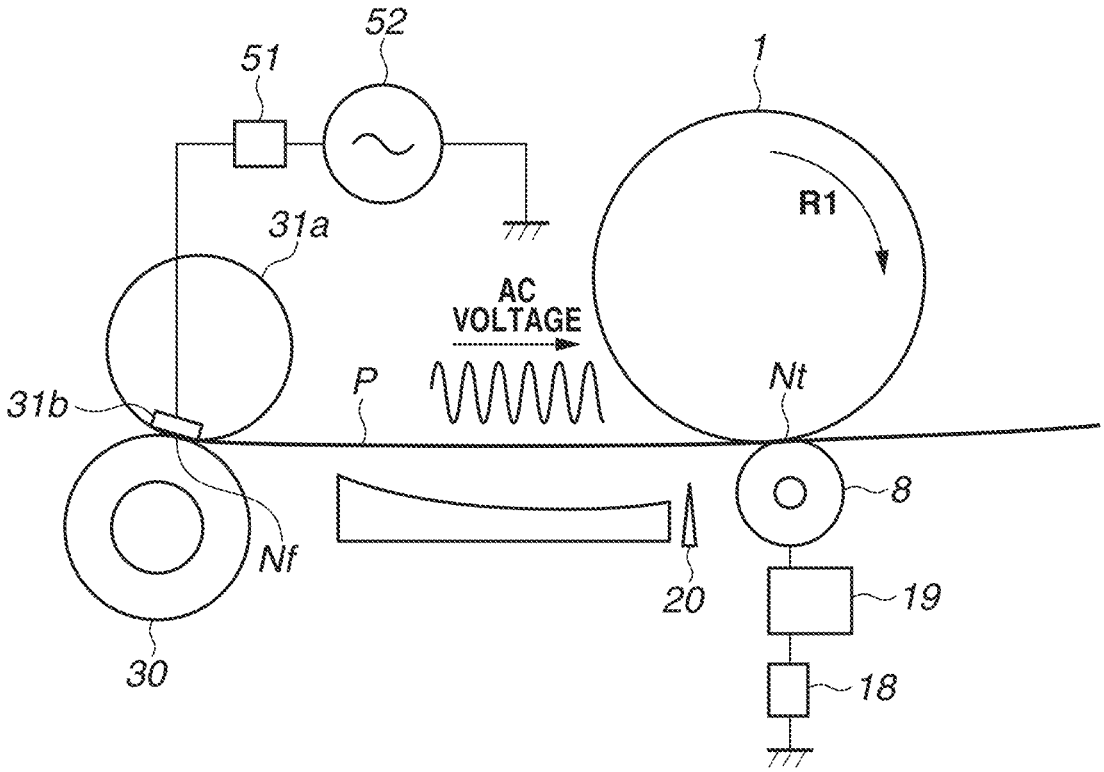
FIG. 9 is a schematic view illustrating a mechanism by which an alternating-current voltage is superimposed on a voltage at the transfer portion via a transfer medium according to the second exemplary embodiment.
Figure 10:
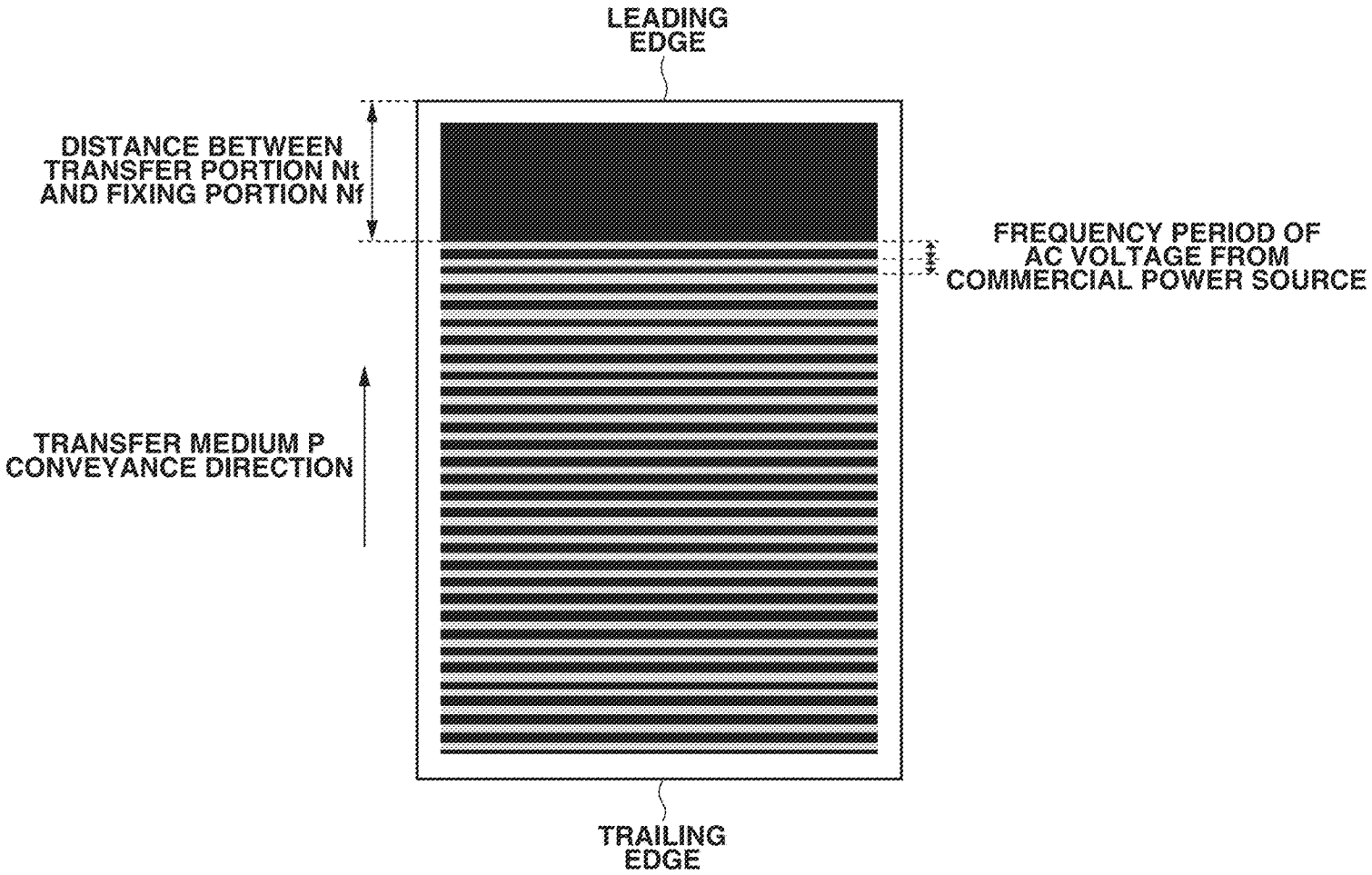
FIG. 10 is a schematic view illustrating an image defect that occurs in the case in which the alternating-current voltage is superimposed on the voltage at the transfer portion via the transfer medium according to the second exemplary embodiment.

In the case in which the resistance of the transfer medium P is low, an image defect as illustrated in FIG. 10 may occur as a result that an alternating-current voltage from the commercial power source 52 is superimposed on the transfer voltage Vt in the transfer portion Nt via the transfer medium P. FIG. 9 is a schematic view illustrating a mechanism of how an image defect occurs as a result that the alternating-current voltage from the commercial power source 52 is superimposed on the transfer voltage Vt in the transfer portion Nt. FIG. 10 is a schematic view illustrating an image defect that occurs as a result that the alternating-current voltage from the commercial power source 52 is superimposed on the transfer voltage Vt in the transfer portion Nt. The transfer medium P in the following description is a A4-size transfer medium P that was left under a high-temperature, high-humidity environment for a long period of time and thus absorbed moisture, and the length of the transfer medium P in the conveyance direction for the transfer medium P is longer than 40 mm which is the distance from the transfer portion Nt to the fixing portion Nf.

As illustrated in FIG. 9, in the case in which the electric resistance of the transfer medium P is low, the alternating-current voltage applied to the heater 31*b* causes a change in the transfer voltage Vt in the transfer portion Nt via the film 31*a* and the transfer medium P. This causes a current flowing from the transfer roller 8 toward the photosensitive drum 1 to fluctuate with the frequency period of the commercial power source 52 (hereinafter, this phenomenon will be referred to as "AC banding"), and an image with non-uniform density is formed as illustrated in FIG. 10. Especially in the case of using a moisture-absorbed sheet having a high moisture content under a high-temperature, high-humidity environment, an image with non-uniform density due to AC banding (hereinafter, the image will be referred to as "AC banding image") occurs significantly.

Under the condition that a current leakage occurs from the transfer portion Nt to the ground via the transfer medium P as described in the first exemplary embodiment, since the electric resistance of the transfer medium P is low, an AC banding image is likely to occur. Furthermore, in such a state, the current flowing from the transfer roller 8 to the photosensitive drum 1 in the transfer portion Nt is likely to decrease due to the current leakage. Specifically, in the case in which AC banding occurs, the toner image transferability in the transfer portion Nt differs between the position at which the current is insufficient and the position at which the current is not insufficient and the transfer is performed, and consequently an AC banding image is formed. Thus, in the case in which AC banding occurs, the occurrence of AC banding is reducible by increasing the absolute value of the voltage to be applied from the transfer power source 18 to the transfer roller 8.

According to the present exemplary embodiment, in the case in which the alternating-current voltage from the commercial power source 52 is superimposed on the transfer voltage Vt via the transfer medium P and the waveform during the frequency period of the alternating-current voltage is thus detected by the detection unit 19, the controller circuit 23 performs control to change the transfer voltage Vt. According to the present exemplary embodiment, the controller circuit 23 changes the voltage to be applied from the transfer power source 18 to the transfer roller 8 from the transfer voltage Vt (first voltage) to a voltage (first voltage) that is the sum of the voltage change width ΔV and the transfer voltage Vt which are set by a method similar to the method according to the first exemplary embodiment.

As described above, the value of the voltage change width ΔV that is set before the transfer medium P is held in the fixing portion Nf is reflected in the transfer control performed after AC banding is detected. This enables more appropriate control of the voltage to be applied from the transfer power source 18 to the transfer roller 8.

More specifically, for example, even in the case in which the electric resistance of the transfer medium P is high and thus the amount of current flowing from the transfer portion Nt to the ground is small, if the image printing ratio is low, i.e., if the amount of toner in the transfer portion Nt is small, the electric resistance in the transfer portion Nt becomes low. In other words, the amount of current flowing from the transfer roller 8 to the photosensitive drum 1 becomes relatively large, and thus the value of the current $I_{tr}$ detected by the detection unit 19 increases, whereby the voltage change width ΔV also increases. As a result, the voltage to be applied from the transfer power source 18 to the transfer roller 8 may be set to an excessively large value.

Meanwhile, the waveform during the frequency period of the alternating-current voltage from the commercial power source 52 is transmitted from the fixing portion Nf to the transfer portion Nt depending on the electric resistance of the transfer medium P regardless of the image printing ratio. Thus, in the case in which the electric resistance of the transfer medium P is high, AC banding is not detected in the transfer portion Nt. Accordingly, the value of the change in the voltage ΔV that is set before the transfer medium P is held in the fixing portion Nf is reflected in the transfer control performed after AC banding is detected so that more appropriate control of the voltage to be applied from the transfer power source 18 to the transfer roller 8 becomes possible.

[Occurrence Detection of AC Banding]

The following describes details of the control according to the present exemplary embodiment which is performed when an entirely black solid image was formed under a high-temperature, high-humidity environment with a room temperature of 32.5 degrees and a humidity of 80% on a transfer medium P, A4-size sheet (grammage 80 g/m$^2$) manufactured by Océ Red Label, that had been left under the same high-temperature, high-humidity environment for 48 hours or longer. According to the present exemplary embodiment, the circumferential speed of the photosensitive drum 1 is 118 mm/seconds, the voltage from the commercial power source 52 is 220 V, and the power source frequency is 50 Hz. Further, the value of the voltage V0 when ATVC control was performed to pass a current of 3 μA was 500 V. Based on this result, the controller circuit 23 set the transfer voltage to be applied from the transfer power source 18 to the transfer roller 8 in the toner image transfer from the photosensitive drum 1 onto the transfer medium P to 750 V and started image forming.

Figure 11A:
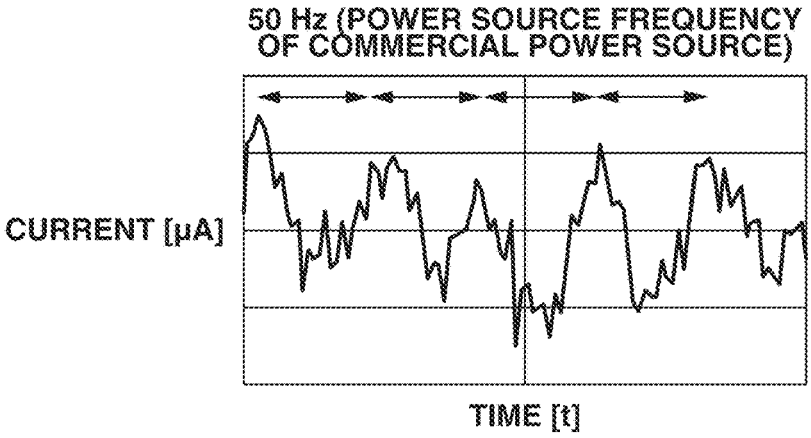
FIGS. 11A, 11B, and 11C are graphs each illustrating a current detection result measured by a detection unit according to the second exemplary embodiment.
Figure 11B:
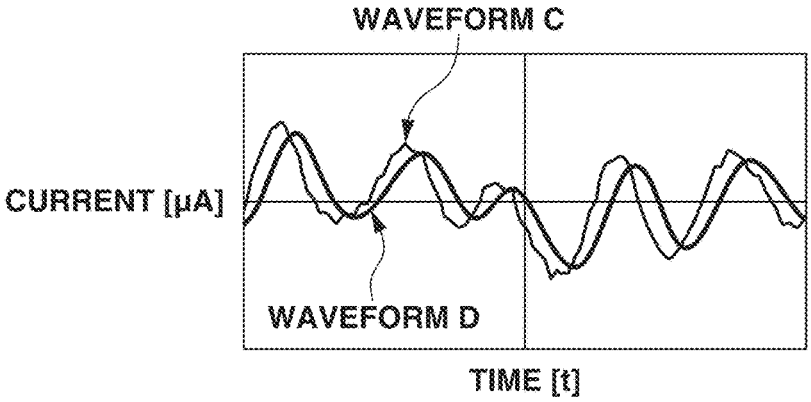
Figure 11C:
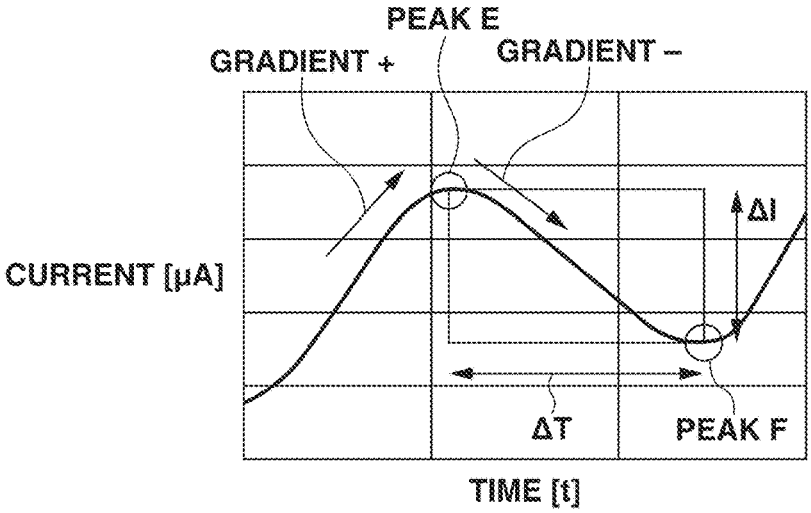

FIG. 11A is a graph illustrating a current detection result measured by the detection unit 19 at the time of AC banding. FIG. 11B is a graph illustrating the simple moving average of the detection result illustrated in FIG. 11A, and FIG. 11C is a graph illustrating an enlarged waveform obtained by calculating the simple moving average of the detection result in FIG. 11B twice.

The current flowing in the transfer roller 8 is detected by the detection unit 19, and if AC banding occurs when the image forming is started and the transfer medium P reaches the fixing portion Nf, the detection unit 19 detects a signal containing noise as illustrated in FIG. 11A. According to the present exemplary embodiment, to remove the noise, the simple moving average of the detection result obtained in FIG. 11A is calculated to obtain a waveform C (first waveform) and a waveform D (second waveform) illustrated in FIG. 11B.

The simple moving average may also be considered as a low-pass filter, and a gain G suitable for use in calculating the simple moving average to obtain a waveform that the amplitudes of frequencies higher than a signal frequency f are attenuated is expressed by formula (3) as shown below. According to the present exemplary embodiment, the power source frequency from the commercial power source 52 is 50 Hz, and the waveforms C and D are obtained using formula (3) to remove, as noise, the amplitudes frequencies higher than 60 Hz from the detection result in FIG. 11A. The score at which the amplitudes of frequencies higher than 60 Hz in the waveform of the detection result in FIG. 11A acquired at 1 ms intervals are attenuated (gain becomes 1/√2) is calculated from the following formula (3):

$$G = \frac{1}{2\pi f \tau}\sqrt{2(1-\cos 2\pi f \tau)}, \tag{3}$$

where G is gain, τ is M (moving average score)×Δt (sampling interval of 1 ms), and f is signal frequency of 60 Hz. From formula (3), the obtained score of the simple moving average (moving average score) is seven.

The waveform C illustrated in FIG. 11B is a waveform obtained by calculating the simple moving average of the waveform of the detection result in FIG. 11A using the moving average score of seven. In the case in which noise still remains in a waveform after the simple moving average is calculated once as in the case of the waveform C, waveform phase shifts and amplitude reduction are reduced not by increasing the moving average score and calculating the simple moving average using the increased moving average score but by calculating the simple moving average of the waveform C again. Thus, according to the present exemplary embodiment, in order to make the alternating-current voltage frequency by AC banding more detectable, the simple moving average of the waveform C is calculated using the moving average score of seven to obtain the waveform D.

As illustrated in FIG. 11C, points in the waveform D, which is obtained as described above, at which the waveform gradient changes are determined as peaks, and a frequency obtained from an interval ΔT between the adjacent peaks is compared with a predetermined frequency range including the frequency of the alternating-current voltage from the commercial power source 52. In FIG. 11C, a peak E at which the gradient of the waveform D changes from positive to negative will be referred to as a first peak, and a peak F at which the gradient of the waveform D changes from negative to positive will be referred to as a second peak. According to the present exemplary embodiment, a frequency ½ΔT is calculated from an interval ΔT between the peaks E and F (half period). Since the power source frequency of the commercial power source that is used in the present exemplary embodiment is 50 Hz, it is determined that AC banding occurs if the value of the frequency ½ΔT is within the predetermined frequency range of 40 Hz<½ΔT<60 Hz.

Alternatively, it can be determined that AC banding occurs if the value of the frequency ½ΔT is within the predetermined frequency range of 40 Hz<½ΔT<70 Hz. In this way of setting, the predetermined frequency range includes both the power source frequencies of 50 Hz and 60 Hz so that AC banding is detectable regardless of whether the power source frequency of the commercial power source is 50 Hz or 60 Hz.

Further, in the present exemplary embodiment, the difference (difference ΔI) between the current values of adjacent peaks is calculated, and the frequency ½ΔT at which the value of the difference ΔI is not less than a predetermined value is compared with the frequency of the alternating-current voltage, as illustrated in FIG. 11C. The value of the difference ΔI is settable according to the control by the image forming apparatus 100, and according to the present exemplary embodiment, the value of the difference ΔI is set to 1 μA. In addition to the setting, it is determined that AC banding occurs if each difference ΔI between three consecutive peaks is not less than 1 μA and if the value of the frequency ½ΔT is within the range of 40 Hz<½ΔT<60 Hz.

The current that flows in the transfer roller 8 can be deflected at the moment when the transfer medium P enters the fixing portion Nf or due to a change in the amount of toner transferred onto the transfer medium P. In order to remove such noise, it is desirable to compare the difference ΔI and the frequency ½ΔT for at least three consecutive peaks (1.5 periods). This prevents detection of such a noise that the current flowing in the transfer roller 8 is deflected due to a cause other than AC banding, and thus AC banding is detectable with great accuracy.

Figure 12:
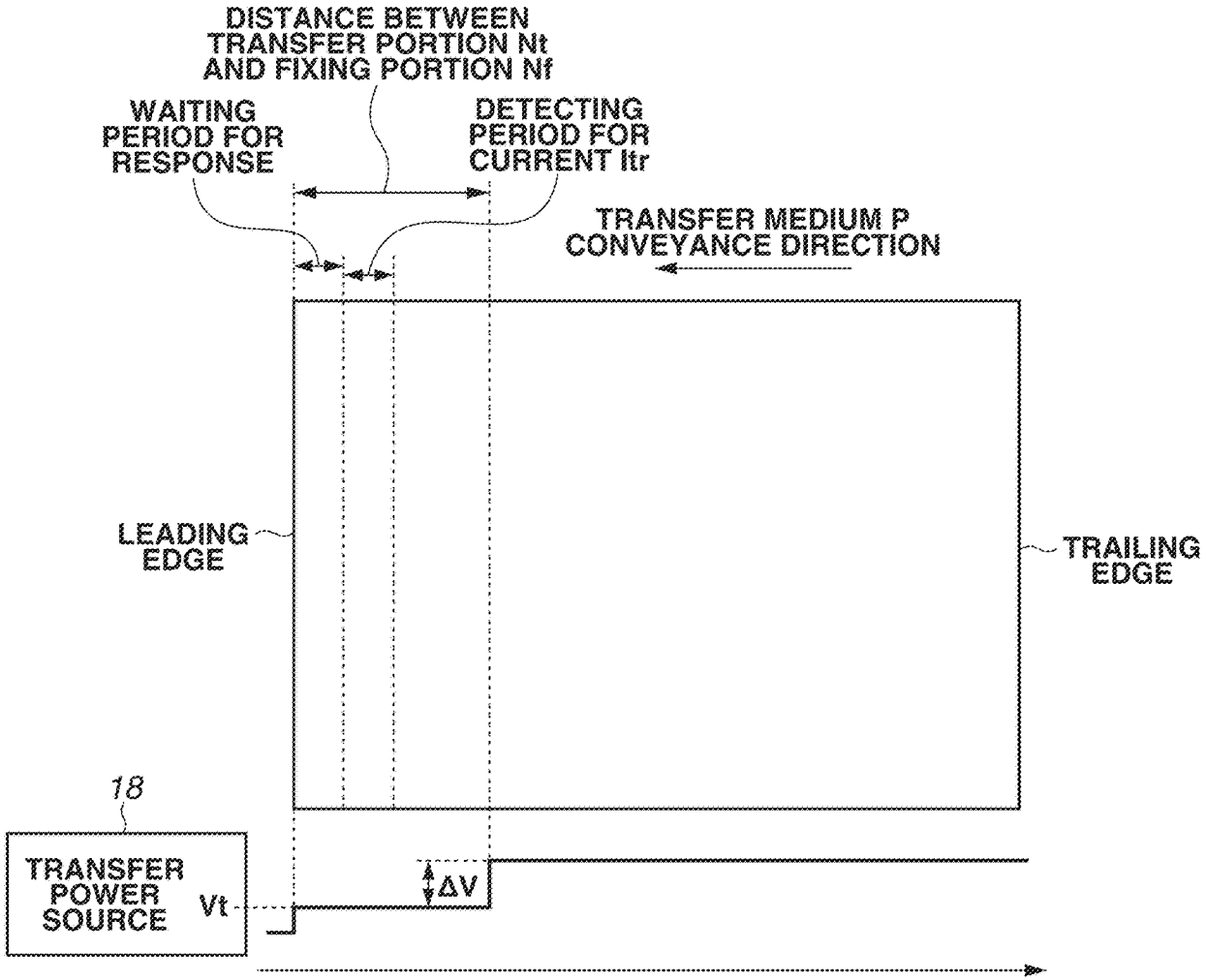
FIG. 12 is a schematic view illustrating the transfer control according to the second exemplary embodiment.

According to the present exemplary embodiment, the difference ΔI and the frequency ½ΔT for five consecutive peaks (2.5 periods) are compared to prevent an occurrence of an image defect, while the accuracy of AC banding detection can further be improved by comparing more peaks. From the foregoing detection result, if the controller circuit 23 determines that AC banding occurs, the controller circuit 23 controls the transfer power source 18 to change the voltage to be applied to the transfer roller 8 from the transfer voltage Vt to a voltage that is the sum of the transfer voltage Vt and the voltage change width ΔV. FIG. 12 is a schematic view illustrating the transfer control according to the present exemplary embodiment.

The method of calculating the voltage change width ΔV is as described above in the first exemplary embodiment. Further, the image forming conditions according to the present exemplary embodiment are similar to those in the first exemplary embodiment. Specifically, as illustrated in FIG. 12, according to the present exemplary embodiment, if it is determined that AC banding occurs, the voltage to be applied from the transfer power source 18 to the transfer roller 8 is changed from the transfer voltage Vt (750 V) to the voltage (1070 V) that is the sum of the transfer voltage Vt and the voltage change width ΔV. Thereafter, the constant voltage control is performed using the voltage (1070 V) that is the sum of the transfer voltage Vt and the voltage change width ΔV. In this way, an AC banding image as illustrated in FIG. 10 is prevented.

Further, in the arrangement according to the present exemplary embodiment, in the case in which the controller circuit 23 determines that no AC banding occurs, the voltage to be applied to the transfer roller 8 is not changed from the transfer voltage Vt even if the value of the current $I_{tr}$ measured before the transfer medium P reaches the fixing portion Nf is large. This enables more appropriate control of the voltage to be applied from the transfer power source 18 to the transfer roller 8.

In the arrangement according to the present exemplary embodiment, in the case of continuous image forming on a plurality of transfer mediums P, the AC banding occurrence detection can be performed on each sheet or on each continuous printing job. For example, in the case in which the detection unit 19 detects an occurrence of AC banding during image forming on a first transfer medium P1 while there remains a job for forming an image on a second transfer medium P2 following the first transfer medium P1, the AC banding detection does not have to be performed on the second transfer medium P2. The transfer mediums P stored in the sheet feeding cassette 15 are under the same environment, and it is thus considered that the type and state of the transfer mediums P are substantially similar. Thus, the voltage to be applied to the transfer roller 8 may be changed based on the same setting as the setting for the first transfer medium P1 at the timing at which the second transfer medium P2 is held in the fixing portion Nf, without performing AC banding detection on the second transfer medium P. In this way, an occurrence of an image defect is prevented while the number of times of AC banding detection is reduced.

Other Exemplary Embodiment

While applications to a monochrome image forming apparatus are described in the above-described exemplary embodiments, the present disclosure is not limited to the above-described exemplary embodiments. An exemplary embodiment of the present disclosure is also applicable to any apparatus including a fixing unit and a transfer member configured to transfer a toner image from an image bearing member onto a transfer medium P. Specifically, as illustrated in FIG. 13, an exemplary embodiment of the present disclosure is also applicable to a color image forming apparatus to produce a similar advantage.

Figure 13:
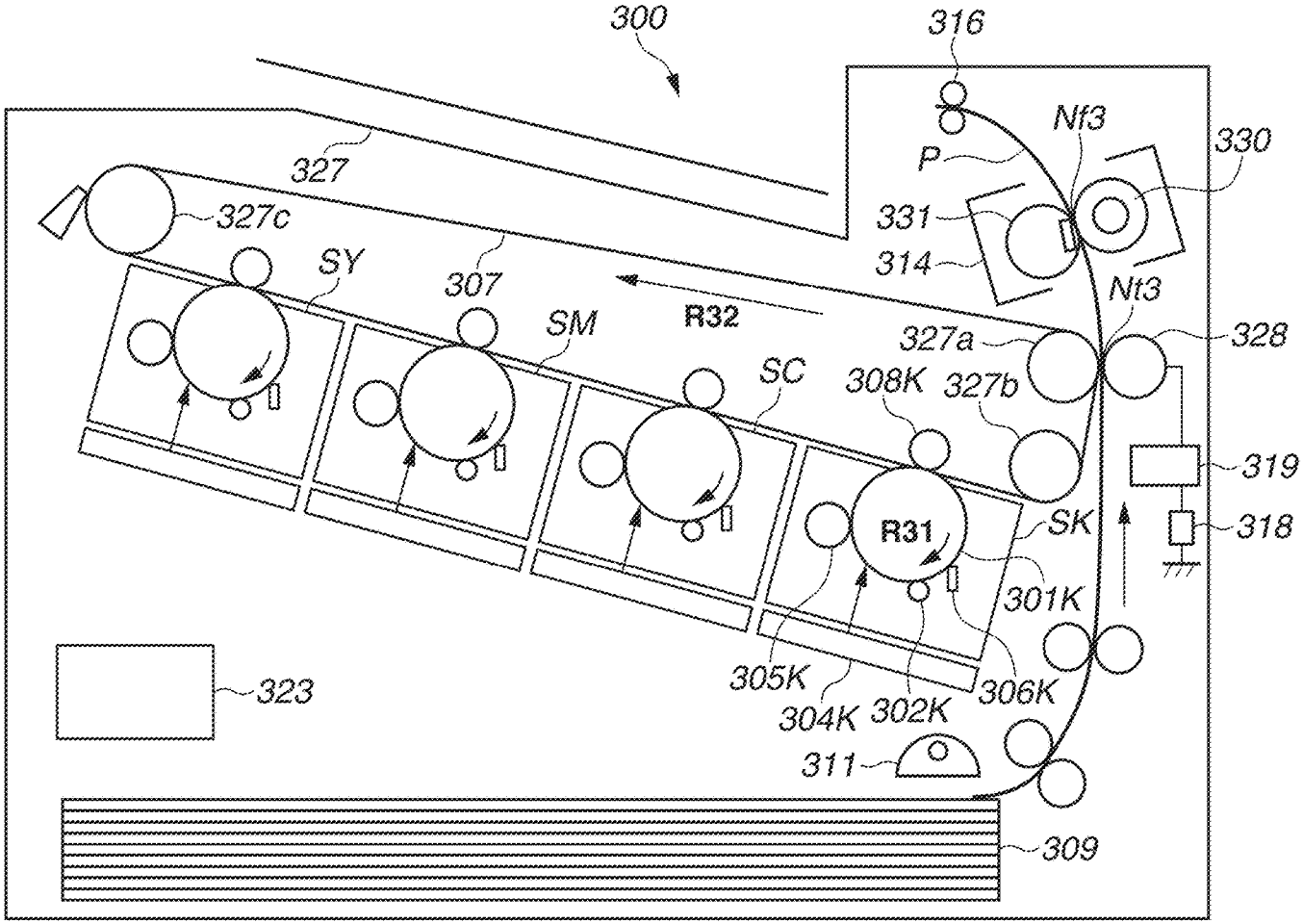
FIG. 13 is a cross sectional view schematically illustrating the structure of the image forming apparatus according to another exemplary embodiment.

FIG. 13 is a cross sectional view schematically illustrating the structure of an image forming apparatus 300 according to the present exemplary embodiment. As illustrated in FIG. 13, the image forming apparatus 300 according to the present exemplary embodiment is a color image forming apparatus in which image forming units SY, SM, SC, and SK configured to form yellow (Y), magenta (M), cyan (C), and black (K) images, respectively, are arranged at regular intervals. According to the present exemplary embodiment, the structures and operations of the image forming units SY, SM, SC, and SK are substantially similar to each other, except that images formed by the image forming units SY, SM, SC, and SK are different in color. Thus, the structure of the image forming apparatus 300 according to the present exemplary embodiment will be described below with reference to the image forming unit SK.

In the image forming apparatus 300 according to the present exemplary embodiment, an image signal transmitted from an information device, such as a personal computer (not illustrated), is received and analyzed in the image forming apparatus 300 and the analyzed image signal is transmitted to a control unit 323. Then, the control unit 323 controls various units to start an image forming operation in the image forming apparatus 300.

The image forming unit SK includes a photosensitive drum 301K which is a drum-shaped photosensitive member, a charging roller 302K which is a charging unit, a development roller 305K which is a development unit, and a cleaning unit 306K. When the image forming operation is started, the photosensitive drum 301K is driven and rotated in the direction indicated by an arrow R31 at a predetermined circumferential speed, and during the rotation process, the photosensitive drum 301K is uniformly charged with a predetermined polarity (which is negative according to the present exemplary embodiment) to a predetermined potential by the charging roller 302K. The photosensitive drum 301K is then exposed by an exposure unit 304K based on the image signal and an electrostatic latent image is formed on the surface of the photosensitive drum 301K. The electrostatic latent image formed on the surface of the photosensitive drum 301K is developed with toner supplied from the development roller 305K and a toner image is formed on the photosensitive drum 301K.

An endless intermediate transfer belt 307 which is an image bearing member stretched around stretching rollers 327*a* to 327*c* which are a stretching member is disposed to face the photosensitive drum 301K, and the intermediate transfer belt 307 is driven and rotated in the direction of an arrow R32 in FIG. 16. A primary transfer roller 308K is provided on the inner periphery of the intermediate transfer belt 307 to press the intermediate transfer belt 307 against the photosensitive drum 301K. Further, a primary transfer portion is formed in a position in which the intermediate transfer belt 307 pressed by the primary transfer roller 308K comes into contact with the photosensitive drum 301K. A toner image formed on the photosensitive drum 301K is primarily transferred from the photosensitive drum 301K onto the intermediate transfer belt 307 while passing through the primary transfer portion. In this way, toner images of the respective colors are primarily transferred from the image forming units SY, SM, SC, and SK onto the intermediate transfer belt 307 to form toner images of a plurality of colors corresponding to a target color image are formed on the intermediate transfer belt 307.

A secondary transfer roller 328 which is a transfer member is disposed to face the stretching roller 327*a* via the intermediate transfer belt 307 which is an image bearing member, and a secondary transfer portion Nt3 which is a transfer portion is formed at the position at which the intermediate transfer belt 307 is in contact with the secondary transfer roller 328. The secondary transfer roller 328 is connected to a transfer power source 318, and the control unit 323 controls the transfer power source 318 to apply a voltage to the secondary transfer roller 328. The toner images of the plurality of colors are thus secondarily transferred from the intermediate transfer belt 307 onto the transfer medium P.

The transfer medium P stacked in the sheet feeding cassette 309 is fed from the sheet feeding cassette 309 by a sheet feeding roller 311 and conveyed to the secondary transfer portion Nt3 in synchronization with the timing at which the toner images of the plurality of colors formed on the intermediate transfer belt 307 reach the secondary transfer portion Nt3. The transfer medium P onto which the toner images of the plurality of colors are secondarily transferred in the secondary transfer portion Nt3 is conveyed to a fixing unit 314 and heated by a heating unit 331 and pressed by a pressing unit 330 and the toners of the respective colors are melted and fixed to the transfer medium P. The transfer medium P is then discharged by a sheet discharge roller 316 to a sheet discharge tray 327 which is a sheet stacking unit.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2017-252537, filed Dec. 27, 2017, which is hereby incorporated by reference herein in its entirety.

What is claimed is:

1. An image forming apparatus comprising:

an image bearing member configured to bear a toner image;

a transfer member configured to form a transfer portion where the transfer member is brought into contact with the image bearing member;

a transfer power source configured to apply a voltage to the transfer member;

a detection unit configured to detect a current flowing in the transfer member when the voltage is applied from the transfer power source to the transfer member;

a control unit configured to control the transfer power source to transfer the toner image from the image bearing member onto a transfer medium by applying a first voltage from the power source to the transfer member, wherein the control unit sets the first voltage based on a value of the voltage applied from the transfer power source to the transfer member during a period that a value of the current detected by the detection unit is a predetermined value while the transfer medium is not held in the transfer portion; and a fixing unit disposed downstream from the transfer member in a conveyance direction of the transfer medium, the fixing unit including a heating member configured to heat the transfer medium and a pressing member configured to form a fixing portion where the pressing member is brought into contact with the heating member, wherein the control unit sets a second voltage to be applied from the transfer power source to the transfer member, based on a simple average value of a current value that is obtained by calculating a simple moving average of current values detected by the detection unit during a predetermined time period, after a leading edge of the transfer medium in the conveyance direction for the transfer medium is held in the transfer portion and while the first voltage is applied from the transfer power source to the transfer member.

2. The image forming apparatus according to claim 1, wherein the control unit changes the voltage to be output from the transfer power source to the transfer member from the first voltage to the second voltage, after the second voltage is set and while the transfer medium is held in the transfer portion, to transfer the toner image from the image bearing member to the transfer medium by the second voltage.

3. The image forming apparatus according to claim 1, wherein the control unit calculates a change width for changing from the first voltage to the second voltage based on the simple average value.

4. The image forming apparatus according to claim 1, wherein the control unit changes the voltage to be output from the transfer power source to the transfer member from the first voltage to the second voltage, while the transfer medium is held in the transfer portion and the fixing portion, to transfer the toner image from the image bearing member to the transfer medium by the second voltage.

5. The image forming apparatus according to claim 1, wherein the control unit sets the second voltage under a setting of the predetermined time period, after a time period passes in which the first voltage is applied from the transfer power source to the transfer member and a signal detected by the detection unit is stabilized.

6. The image forming apparatus according to claim 1,
wherein the heating member includes
a heating unit to which a heating voltage is applied from an alternating-current power source to heat the transfer medium held in the fixing portion, and
a roll-shaped flexible member covering the heating unit,
wherein the fixing portion is formed at a position where the heating unit is pressed by the pressing member via the flexible member.

7. The image forming apparatus according to claim 6, wherein the flexible member is a conductive film.

8. The image forming apparatus according to claim 6,
wherein the heating unit includes a substrate, an electrode portion, and a heat generation resistor, the voltage from the alternating-current power source being applied to the electrode portion, and the heat generation resistor being formed on a surface of the substrate,
wherein the heat generation resistor generates heat in such a manner that a current flows in the heat generation resistor via the electrode portion by the voltage applied from the alternating-current power source to the electrode portion, and
wherein the heating unit heats the transfer medium held in the fixing portion by the heat generated by the heat generation resistor.

9. The image forming apparatus according to claim 1, further comprising a bidirectional thyristor disposed between an electrode portion and an alternating-current power source,
wherein the control unit controls a current flowing in the bidirectional thyristor to control a voltage to be applied from the alternating-current power source to the electrode portion.

10. The image forming apparatus according to claim 1, wherein the control unit is configured to change the voltage to be applied from the transfer power source to the transfer member from the first voltage to the second voltage, based on a result of comparison between a frequency obtained from a detection result detected by the detection unit and a predetermined frequency range including a power source frequency of an alternating-current power source while the transfer medium is held in the transfer portion and the fixing portion.

11. The image forming apparatus according to claim 10, wherein in a case where the frequency obtained from the detection result is within the predetermined frequency range, the control unit changes the voltage to be applied from the transfer power source to the transfer member from the first voltage to the second voltage.

12. The image forming apparatus according to claim 11, wherein the control unit changes the voltage to be applied from the transfer power source to the transfer member from the first voltage to the second voltage in a case where, after the control unit obtains a first waveform once by calculating a simple moving average for the detection result, the control unit determines, as a peak, a point at which a gradient of a second waveform obtained by calculating a simple moving average of a first waveform and a frequency obtained from an interval between adjacent peaks is within the predetermined frequency range.

13. The image forming apparatus according to claim 12, wherein the adjacent peaks are a first peak at which the gradient of the second waveform changes from positive to negative and a second peak at which the gradient of the second waveform changes from negative to positive, and in a case where the frequency obtained from the interval between the first peak and the second peak is within the predetermined frequency range, the control unit changes the voltage to be applied from the transfer power source to the transfer member from the first voltage to the second voltage.

14. The image forming apparatus according to claim 13, wherein in a case where a current value difference between the first peak and the second peak of the second waveform is equal to or greater than a predetermined value and the frequency obtained from the interval between the first peak and the second peak is within the predetermined frequency range, the control unit changes the voltage to be applied from the transfer power source to the transfer member from the first voltage to the second voltage.

15. The image forming apparatus according to claim 12, wherein in a case where current value differences between adjacent peaks among at least three consecutive peaks of the second waveform are each equal to or larger than the predetermined value and frequencies each obtained from the intervals between the adjacent peaks are within the predetermined frequency, the control unit changes the voltage to be applied from the transfer power source to the transfer member from the first voltage to the second voltage.

16. The image forming apparatus according to claim 10, wherein in a case where the frequency obtained from the detection result is not within the predetermined frequency range, the control unit does not change the voltage to be applied from the transfer power source to the transfer member from the first voltage to the second voltage, and transfers the toner image from the image bearing member to the transfer medium by the first voltage.

17. The image forming apparatus according to claim 1, further comprising
a conductive member which is electrically conductive with respect to the transfer medium held in the transfer portion,
wherein the conductive member is electrically grounded without an electric resistor.

18. The image forming apparatus according to claim 17, further comprising
a storage unit which is disposed upstream from the transfer portion in the conveyance direction for the transfer medium and stores the transfer medium to be conveyed toward the transfer portion,
wherein the conductive member is a metal plate provided to the storage unit.

19. The image forming apparatus according to claim 1, further comprising
a development unit configured to supply a toner image to the image bearing member, wherein the image bearing member is a photosensitive member on which an electrostatic latent image is developed by the development unit.

20. The image forming apparatus according to claim 1, further comprising a photosensitive member, wherein the image bearing member is an endless intermediate transfer belt configured to bear a toner image transferred from the photosensitive member.

* * * * *